US011339015B2

(12) United States Patent
Chiba

(10) Patent No.: US 11,339,015 B2
(45) Date of Patent: May 24, 2022

(54) SHEET FEEDING APPARATUS AND IMAGE FORMING APPARATUS

(71) Applicant: CANON KABUSHIKI KAISHA, Tokyo (JP)

(72) Inventor: Yoshinao Chiba, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 148 days.

(21) Appl. No.: 16/703,961

(22) Filed: Dec. 5, 2019

(65) Prior Publication Data

US 2020/0207562 A1 Jul. 2, 2020

(30) Foreign Application Priority Data

Dec. 27, 2018 (JP) ..... JP2018-246302

(51) Int. Cl.
*B65H 3/06* (2006.01)

(52) U.S. Cl.
CPC ..... *B65H 3/0684* (2013.01); *B65H 3/0607* (2013.01); *B65H 3/0661* (2013.01)

(58) Field of Classification Search
CPC ... B65H 1/14; B65H 1/24; B65H 1/00; B65H 3/0684; B65H 3/0607; B65H 3/0661; G03G 15/00
USPC ..... 271/147
See application file for complete search history.

(56) References Cited

U.S. PATENT DOCUMENTS 4,535,982 A * 8/1985 Mochimaru ..... B65H 1/266 271/127
6,354,586 B1 * 3/2002 Samoto ..... B65H 1/14 271/127
9,102,486 B2 * 8/2015 Yoshitsugu ..... B65H 1/08
9,254,973 B2 2/2016 Ishida et al.
9,327,926 B2 5/2016 Chiba
9,919,883 B2 * 3/2018 Fuse ..... G03G 15/6511
10,543,996 B2 1/2020 Chiba
2015/0084270 A1 * 3/2015 Lo ..... B65H 1/12 271/147
2015/0108713 A1 * 4/2015 Yoshitsugu ..... B65H 1/266 271/217

(Continued)

FOREIGN PATENT DOCUMENTS

JP 6-72565 * 3/1994
JP 2007-254144 A 10/2007

OTHER PUBLICATIONS

Machine translation of JP 6-72565. (Year: 1994).*

*Primary Examiner* — Thomas A Morrison
(74) *Attorney, Agent, or Firm* — Venable LLP

(57) ABSTRACT

A sheet feeding apparatus includes a storage portion, a sheet supporting portion, a feed portion, a drive portion to output driving force that lifts the sheet supporting portion, and a rotation shaft rotatably supported by the storage portion and including an engaging portion disposed on one end side in an axial direction of the rotation shaft. The engaging portion engages with the drive portion, and a pressing portion is fixed to the rotation shaft and presses the sheet supporting portion from below when the rotation shaft is rotated by the drive portion. A rotary damper joins with the rotation shaft on another end side of the rotation shaft and reduces rotary motion of the rotation shaft. The pressing portion is disposed between the engaging portion and the rotary damper in the axial direction.

12 Claims, 6 Drawing Sheets

(56) References Cited

U.S. PATENT DOCUMENTS

2018/0307174 A1* 10/2018 Hayayumi ..... G03G 15/6502

* cited by examiner

SHEET FEEDING APPARATUS AND IMAGE FORMING APPARATUS

BACKGROUND OF THE INVENTION

Field of the Invention

The present invention relates to a sheet feeding apparatus that feeds sheets, and an image forming apparatus.

Description of the Related Art

Image forming apparatuses such as printers, facsimiles, and copying machines include a sheet feeding apparatus. The sheet feeding apparatus includes a cassette that stores a plurality of sheets, and a pickup roller that picks up and feeds the sheets stored in the cassette. In general, such a sheet feeding apparatus lifts up a sheet bundle stacked on a sheet stacking plate, to a predetermined sheet height; and causes a pickup roller to pick up and feed a sheet to a main body of the image forming apparatus.

The cassette can be inserted to and drawn from the image forming apparatus to supply sheets. In addition, a lifter motor to lift up the sheet stacking plate and a driving-force transmission mechanism to transmit the driving force produced from the lifter motor are disposed inside the image forming apparatus, and a lift-up member to lift up the sheet stacking plate is disposed in the cassette. Thus, when the cassette is inserted to the image forming apparatus, an engaging portion of a rotation shaft to drive the lift-up member, and the driving-force transmission mechanism to transmit the driving force produced from the lifter motor are engaged with each other.

However, when the cassette is drawn from the image forming apparatus, the rotation shaft and the driving-force transmission mechanism are disengaged from each other. In this time, the lift-up member and the sheet stacking plate drop and collide with a bottom surface of the cassette, possibly causing a large collision sound and giving a user an unpleasant feeling. As countermeasures, Japanese Patent Application Publication No. 2007-254144 proposes a technique in which a rotary damper is attached onto the rotation shaft to reduce a drop speed of the lift-up member and the sheet stacking plate and suppress the collision sound.

The rotary damper described in Japanese Patent Application Publication No. 2007-254144 is disposed on a leading end side of the rotation shaft in the axial direction of the rotation shaft, that is, in an insertion direction of the cassette (the insertion direction is one of insertion-and-drawing directions of the cassette). Specifically, the rotary damper is disposed on a back side of the image forming apparatus. On the back side of the rotation shaft, however, the engaging portion is required to be disposed so as to engage with the driving-force transmission mechanism as described above. Here, the driving-force transmission mechanism transmits the driving force produced from the lifter motor. In addition, in the configuration in which both the engaging portion and the rotary damper are disposed on the back side in the image forming apparatus, since the rotary damper is disposed on the outer circumferential surface of the rotation shaft, a large space is necessary in the cassette for disposing the rotary damper. However, since another space to store the sheets is required in the cassette, the space for the rotary damper may not be able to be secured.

SUMMARY OF THE INVENTION

The present invention provides a sheet feeding apparatus including a space-saving rotary damper that reduce the collision sound, and an image forming apparatus.

According to one aspect of the present invention, a sheet feeding apparatus includes a storage portion configured to store a sheet, a sheet supporting portion configured to support the sheet, the sheet supporting portion being supported so as to be able to pivot on a fulcrum disposed in the storage portion, and being configured to lift the sheet when the sheet supporting portion pivots, a feed portion disposed above the sheet supporting portion and configured to feed the sheet lifted by the sheet supporting portion, a drive portion configured to output driving force that lifts the sheet supporting portion, a rotation shaft rotatably supported by the storage portion and including an engaging portion disposed on one end side in an axial direction, the engaging portion being configured to engage with the drive portion, a pressing portion fixed to the rotation shaft and configured to press the sheet supporting portion from below when the rotation shaft is rotated by the drive portion, and a rotary damper disposed so as to join with the rotation shaft on another end side of the rotation shaft and configured to reduce rotary motion of the rotation shaft.

Further features of the present invention will become apparent from the following description of exemplary embodiments with reference to the attached drawings.

DESCRIPTION OF THE EMBODIMENTS

Configuration of Image Forming Apparatus

Hereinafter, a sheet feeding apparatus and an image forming apparatus of an embodiment will be described with reference to the accompanying drawings. An image forming apparatus 1 of the present embodiment is a full-color laser beam printer that forms an image on a sheet S in accordance with image information data sent from an external device, such as a personal computer. The sheet S is a thin recording medium such as a paper sheet, a plastic film, or a cloth sheet. The paper sheet may be a sheet of plain paper or thick paper, which has an even thickness, or may be a sheet such as an envelope, which has an uneven thickness. The plastic film may be an overhead projector (OHT) sheet.

Figure 1:
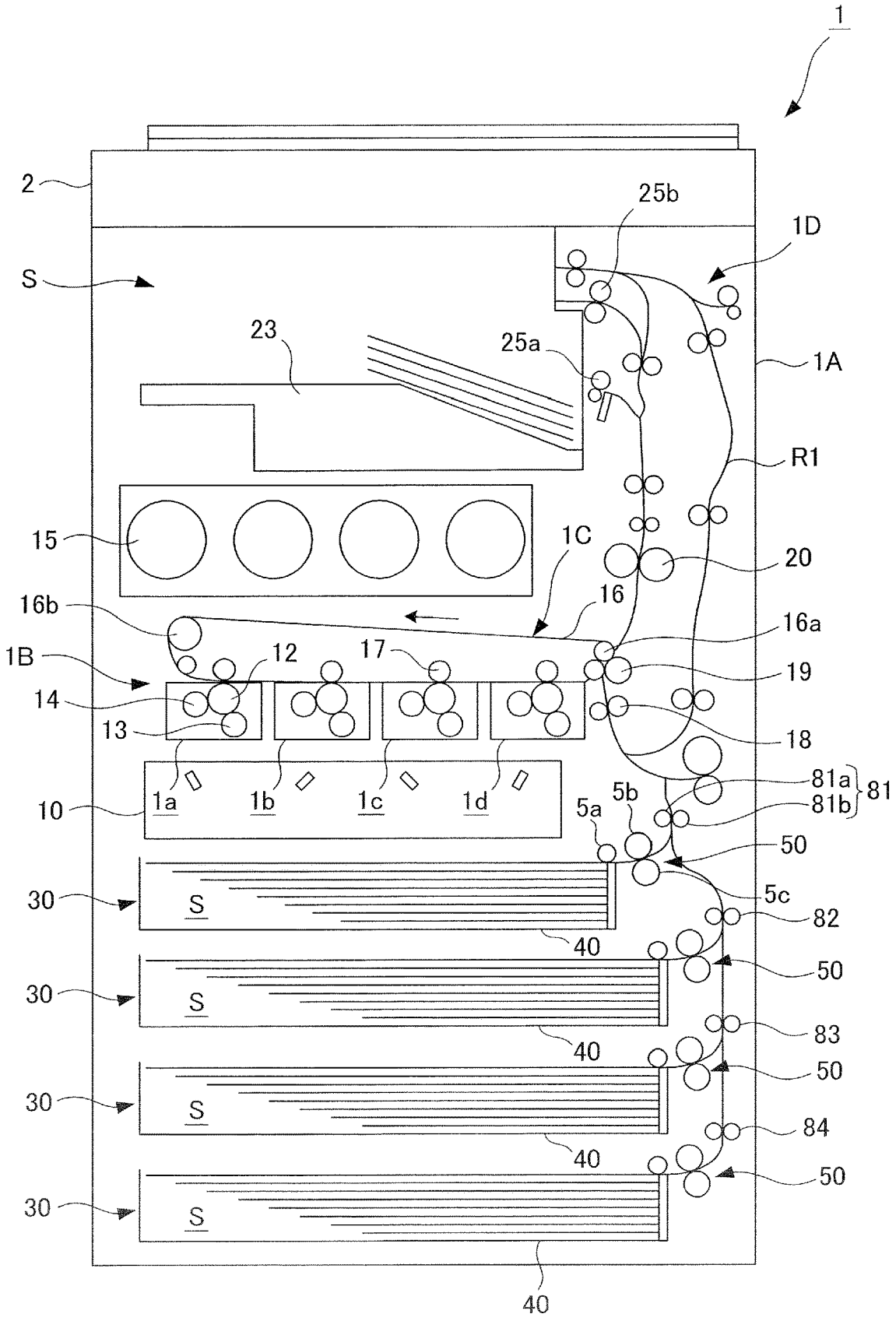
FIG. 1 is a diagram schematically illustrating a configuration of an image forming apparatus of an embodiment.

As illustrated in FIG. 1, the image forming apparatus 1 includes an apparatus body 1A, which contains an image forming portion 1B to form an image on the sheet S and a fixing portion 20 to fix the image to the sheet S. Above the apparatus body 1A, an image reading apparatus 2 to read image data of a document is disposed such that a surface of the image reading apparatus 2 on which the document is placed is substantially horizontal. In addition, a discharging tray 23 is disposed in a sheet discharging space formed between the image reading apparatus 2 and the apparatus body 1A. In a lower portion of the apparatus body 1A, one or more (four in FIG. 1) sheet feeding apparatuses 30 are disposed for feeding the sheet S to the image forming portion 1B. Each of the sheet feeding apparatuses 30 includes a cassette 40 to store a sheet bundle, which is a plurality of sheets S. In addition, each of the sheet feeding apparatuses 30 includes a sheet feeding portion 50 to feed an uppermost sheet of the sheet bundle, one by one, stored in the cassette 40. The sheet feeding portion 50 includes a pickup roller 5*a*, a feed roller 5*b*, and a retard roller 5*c*. A configuration of the sheet feeding apparatuses 30 will be described in detail later.

The image forming portion 1B has a so-called four-drum full-color system including a laser scanner 10, four process cartridges 1*a*, 1*b*, 1*c*, and 1*d*, and an intermediate transfer unit 1C. The process cartridges 1*a*, 1*b*, 1*c*, and 1*d* respectively form toner images of yellow, magenta, cyan, and black. Each of the process cartridges 1*a*, 1*b*, 1*c*, and 1*d* includes a photosensitive drum 12 that is a photosensitive member, a charger 13, a development unit 14, and a cleaner (not illustrated). Above the image forming portion 1B, toner cartridges 15 that contain toner of yellow, magenta, cyan, and black are detachably attached to the apparatus body 1A.

In the intermediate transfer unit 1C, an intermediate transfer belt 16, which is an intermediate transfer member, is wound around a driving roller 16*a* and a tension roller 16*b*. The intermediate transfer unit 1C is disposed above the four process cartridges 1*a*, 1*b*, 1*c*, and 1*d*. The intermediate transfer belt 16 is rotated counterclockwise by the driving roller 16*a* driven by a driving portion (not illustrated), while in contact with the photosensitive drum 12 of each of the process cartridges 1*a*, 1*b*, 1*c*, and 1*d*. The intermediate transfer unit 1C includes primary transfer rollers 17, and each of the primary transfer rollers 17 abuts against the inner circumferential surface of the intermediate transfer belt 16 at a position facing the corresponding photosensitive drum 12. In addition, the image forming portion 1B includes a secondary transfer roller 19 that abuts against the outer circumferential surface of the intermediate transfer belt 16 at a position facing the driving roller 16*a*.

In each of the process cartridges 1*a*, 1*b*, 1*c*, and 1*d*, an electrostatic latent image is formed on the surface of the photosensitive drum 12 by the laser scanner 10, and developed into a toner image negatively charged and having a corresponding color when toner is supplied from the development unit 14. Toner images developed in this manner are multiple-transferred (primary-transferred) onto the intermediate transfer belt 16 when a positive transfer bias voltage is applied to the primary transfer rollers 17, so that a full-color toner image is formed on the intermediate transfer belt 16.

While the toner image is formed, the sheet S fed from the sheet feeding apparatus 30 is conveyed toward a registration roller pair 18, and the skew of the sheet S is corrected by the registration roller pair 18. Then the registration roller pair 18 conveys the sheet S to a secondary transfer portion formed between the intermediate transfer belt 16 and the secondary transfer roller 19, at a timing when the full-color toner image formed on the intermediate transfer belt 16 is transferred. The toner image borne by the intermediate transfer belt 16 is secondary-transferred onto the sheet S when a positive transfer bias voltage is applied to the secondary transfer roller 19.

When the sheet S on which the toner image has been transferred is heated and pressurized in the fixing portion 20, the toner image is fixed to the sheet S, as a color image. The sheet S to which the color image has been fixed is discharged to the discharging tray 23 by a discharging roller pair 25*a*, and stacked on the discharging tray 23. In a case where images are formed on both sides of the sheet S, the sheet S having passed through the fixing portion 20 is conveyed toward an opposite direction by a reversing roller pair 25*b*, which is disposed in an inversion conveyance portion 1D and can rotate in a forward or a reverse direction. When the sheet S is conveyed again to the image forming portion 1B through a re-conveyance path R1, an image is formed on the back side of the sheet S. The sheet S is then discharged onto the discharging tray 23, and the duplex printing is completed.

Configuration of Sheet Feeding Apparatus

Figure 2A:
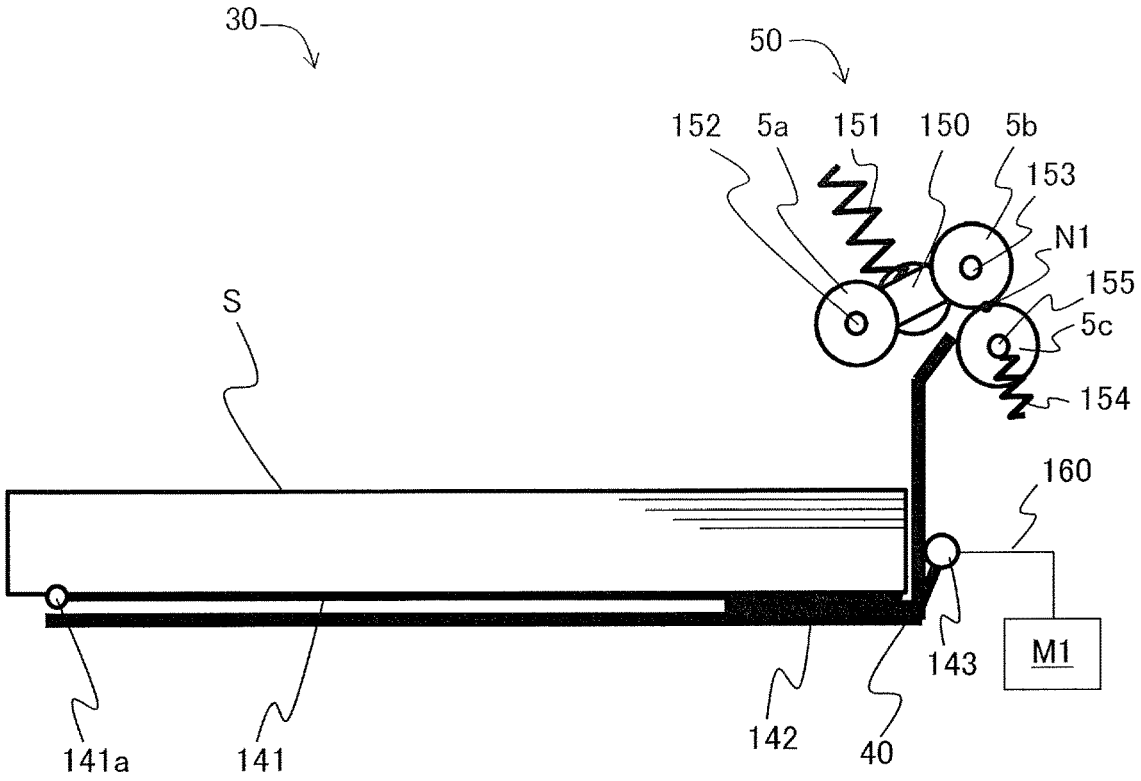
FIG. 2A is a diagram schematically illustrating a sheet feeding apparatus of the embodiment, in a state where a lift-up operation is still not performed.

Next, a configuration of the sheet feeding apparatus 30 will be described with reference to FIGS. 2 to 5. As illustrated in FIG. 2A, the sheet feeding apparatus 30 includes the cassette 40 and the sheet feeding portion 50. The cassette 40 is detachably attached to the apparatus body 1A (see FIG. 1). Specifically, the cassette 40 is supported by the apparatus body 1A such that the cassette 40 can be inserted to or drawn from the apparatus body 1A in an insertion-and-drawing direction. The insertion-and-drawing direction is the axial direction of a later-described lifter shaft 143. The sheet feeding portion 50 feeds an uppermost sheet of the sheet bundle stored in the cassette 40. The cassette 40 includes a sheet stacking plate 141 that is a sheet supporting portion, and a lifter plate 142 that is a pressing portion.

Figure 2B:
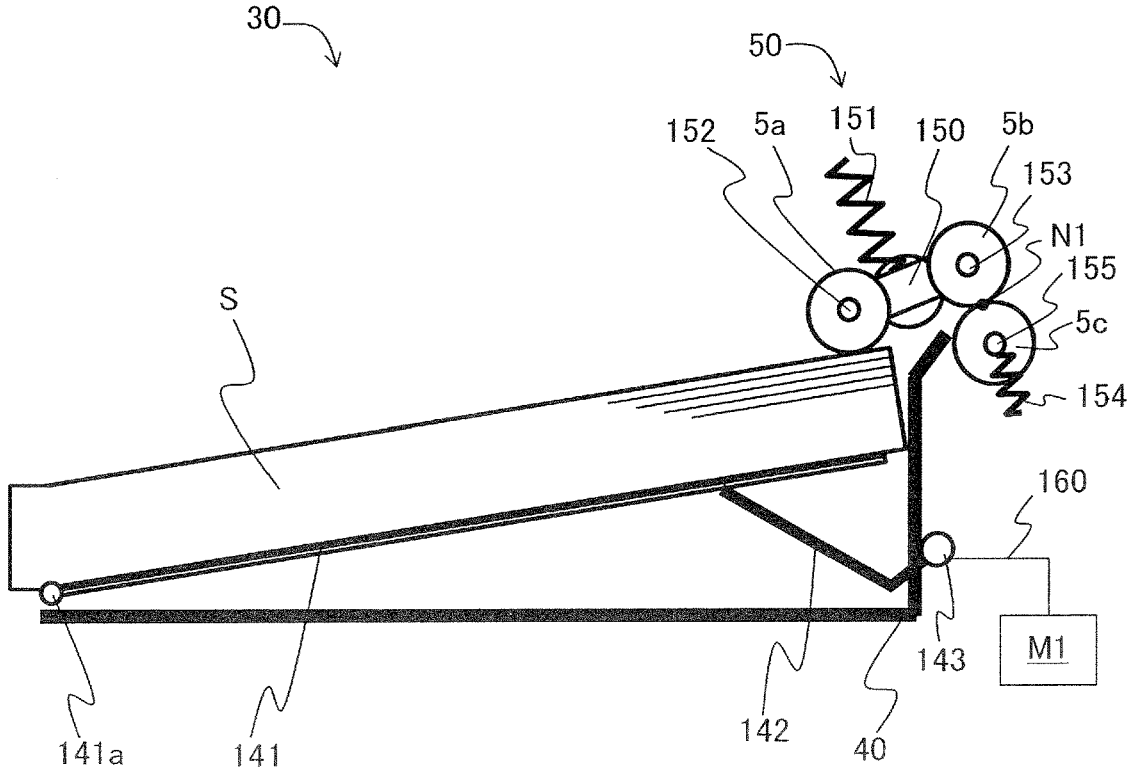
FIG. 2B is a diagram schematically illustrating the sheet feeding apparatus of the embodiment, in a state where the lift-up operation is already performed.

The sheet stacking plate 141 supports the sheet bundle, and is supported by the cassette 40 so as to be able to pivot on a tray pivoting shaft 141*a*, which is disposed in the cassette 40 and serves as a fulcrum. When the sheet stacking plate 141 is pivoted as illustrated in FIG. 2B, the sheet stacking plate 141 lifts the sheet bundle. The lifter plate 142 is fixed to the lifter shaft 143, which is a rotation shaft, via two screws 199 (see FIG. 6B). When the lifter plate 142 is pivoted on the lifter shaft 143, the lifter plate 142 pushes the sheet stacking plate 141 upward from below, and lifts the sheet stacking plate 141 and the sheet bundle.

Figure 5:
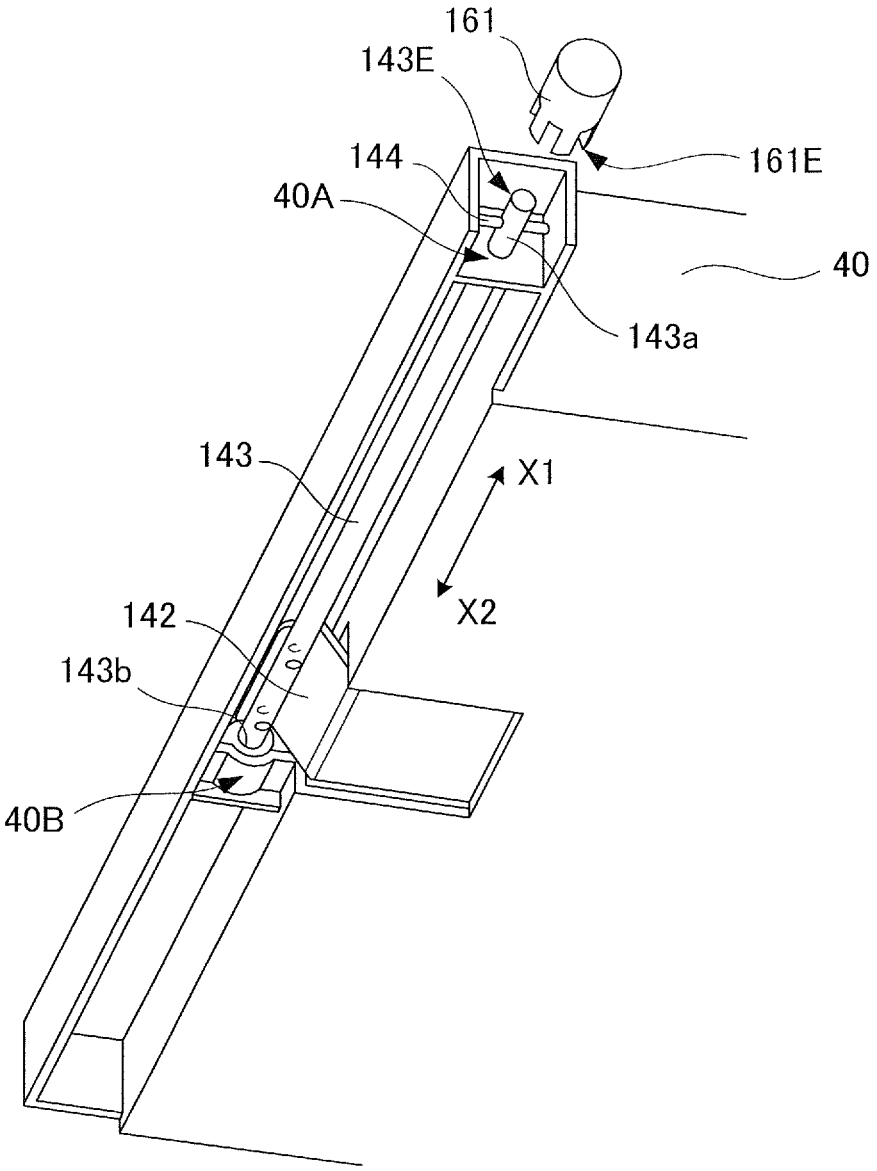
FIG. 5 is a partial perspective view of a portion of a cassette of the embodiment, in which portion a rotation shaft is disposed.

When the cassette 40 is inserted to the apparatus body 1A, the lifter shaft 143 is joined with a lifter motor M1 that is a driving portion, and with the driving-force transmission mechanism 160 that transmits the driving force and rotation produced from the lifter motor M1. The lifter shaft 143 is rotated by the driving force outputted from the lifter motor M1 and the driving-force transmission mechanism 160 to lift the sheet stacking plate 141, and pivots the lifter plate 142. Specifically, as illustrated in FIG. 5, the lifter shaft 143 is rotatably supported by a back-side supporting portion 40A and a front-side supporting portion 40B, both disposed in the cassette 40. The back-side supporting portion 40A is disposed on an insertion direction side (i.e. X1 direction side, or back side in the apparatus body 1A) in the axial direction of the lifter shaft 143 of the cassette 40. The insertion direction is a direction toward which the cassette 40 is inserted to the apparatus body 1A. The front-side supporting portion 40B is disposed on a drawing direction side (i.e. X2 direction side, or front side in the apparatus body 1A) in the axial direction of the lifter shaft 143 of the cassette 40. The drawing direction is a direction toward which the cassette 40 is drawn from the apparatus body 1A. The lifter shaft 143 has an end portion 143*a* formed on the insertion direction side (i.e. X1 direction side, or back side in the apparatus body 1A) in the axial direction. That is, the end portion 143*a* is located on one end side in the axial direction. The end portion 143*a* is provided with an engaging portion 143E. The engaging portion 143E is provided with an engagement shaft 144, which passes through the lifter shaft 143 and is fixed to the lifter shaft 143.

In addition, the driving-force transmission mechanism 160 disposed in the apparatus body 1A is provided with a coupling 161. The coupling 161 includes an engaged portion 161E to be engaged with the engaging portion 143E. The coupling 161 has concave and convex teeth formed on the drawing direction side (i.e. X2 direction side, or front side in the apparatus body 1A). Thus, when the engagement shaft 144 fixed to the lifter shaft 143 enters concave portions of the teeth, the engagement shaft 144 engages with the coupling 161 so as to be able to rotate with the coupling 161 in the rotational direction. That is, when the cassette 40 is inserted and attached to the apparatus body 1A, the coupling 161 and the engagement shaft 144 mesh with each other, and the engaging portion 143E and the engaged portion 161E engage with each other. In contrast, when the cassette 40 is drawn and separated from the apparatus body 1A, the coupling 161 and the engagement shaft 144 are separated from each other, and the engaging portion 143E and the engaged portion 161E are disengaged from each other. In other words, the engaging portion 143E and the engaged portion 161E constitute a claw clutch, in which they are engaged with each other when joined with each other in the axial direction and disengaged from each other when separated from each other in the axial direction.

Figure 3:
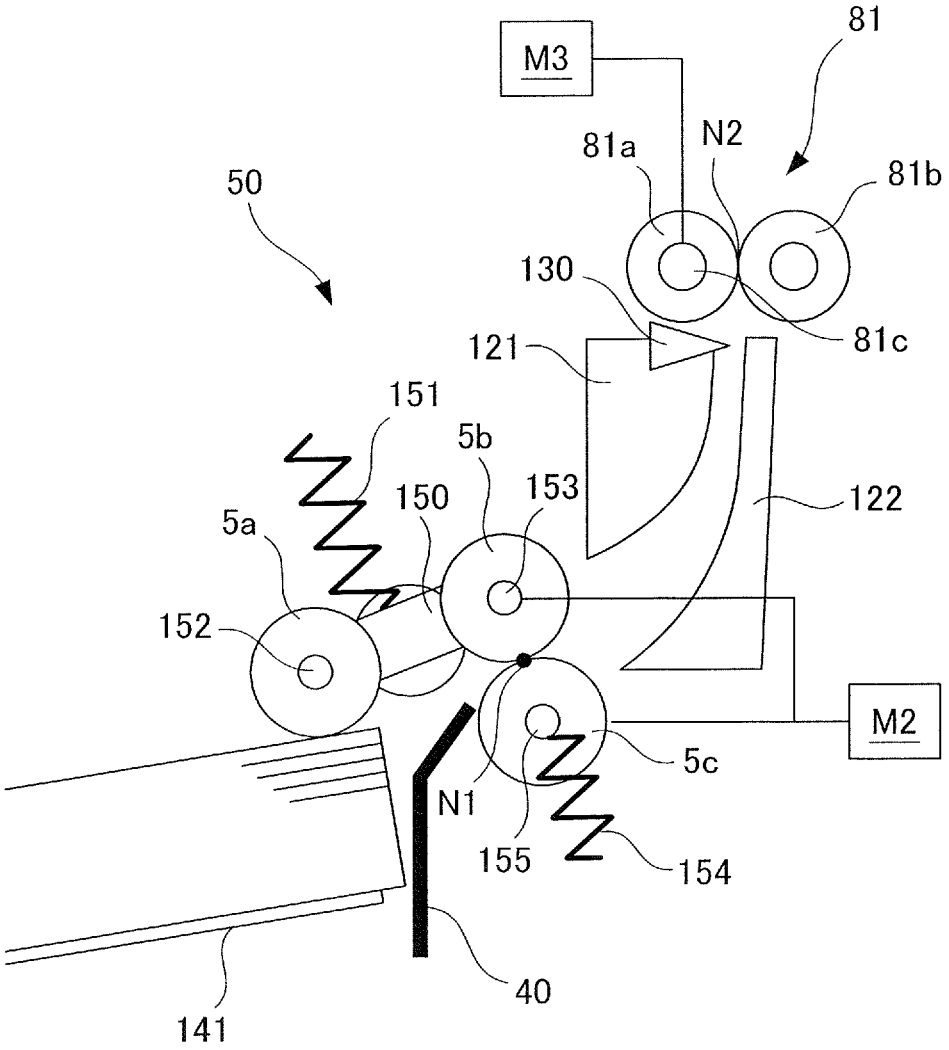
FIG. 3 is a diagram schematically illustrating a configuration of a portion from a sheet feeding portion to a conveyance roller pair in the embodiment.

As illustrated in FIGS. 2A, 2B, and 3, the sheet feeding portion 50 generally includes the pickup roller 5*a*, the feed roller 5*b*, and the retard roller 5*c*. The feed roller 5*b* is rotatably supported by a feed roller shaft 153, which is driven by a feed motor M2. The feed roller shaft 153 supports a lifting-and-lowering plate 150 such that the lifting-and-lowering plate 150 can swing.

Figure 4:
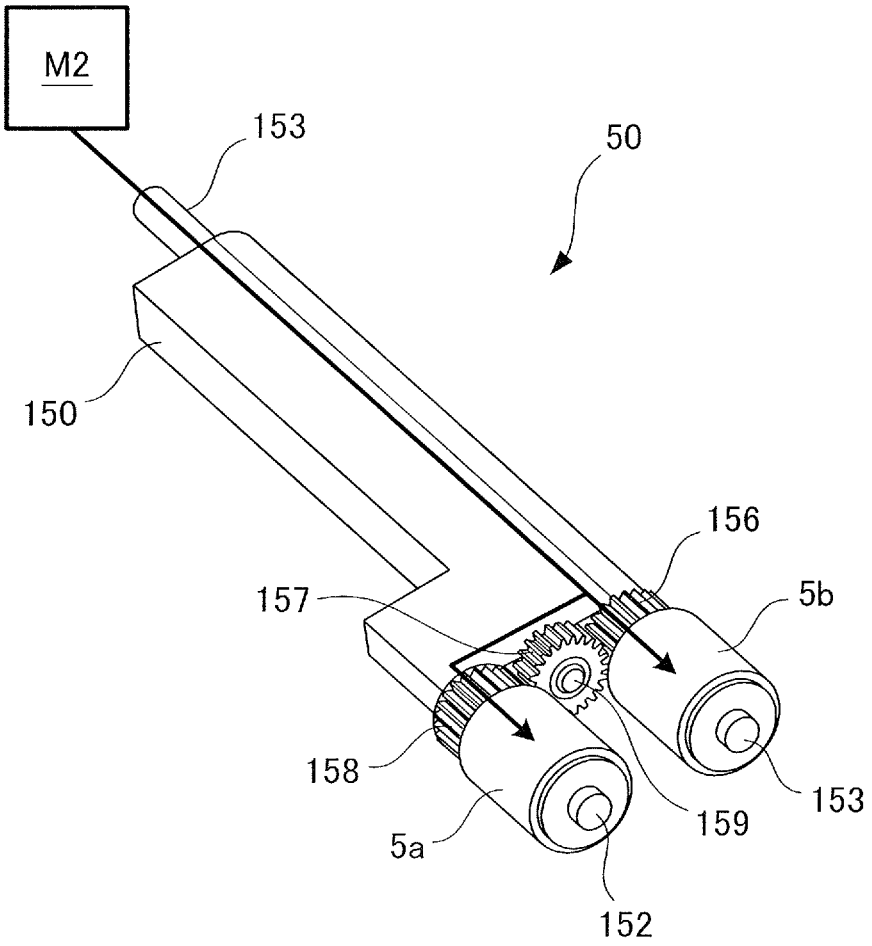
FIG. 4 is a perspective view schematically illustrating a configuration of the sheet feeding portion of the embodiment.

As illustrated in FIG. 4, the lifting-and-lowering plate 150 supports an idler shaft 159 and a pickup roller shaft 152. The pickup roller shaft 152 rotatably supports the pickup roller 5*a*. The feed roller shaft 153, the idler shaft 159, and the pickup roller shaft 152 are respectively provided with a feed gear 156, an idler gear 157, and a pickup gear 158. Thus, the rotation of the feed roller shaft 153 driven by the feed motor M2 is transmitted to the pickup roller shaft 152 and the pickup roller 5*a*, via the feed gear 156, the idler gear 157, and the pickup gear 158.

As illustrated in FIGS. 2B and 3, the lifting-and-lowering plate 150 is urged downward by a pickup spring 151. Thus, the pickup roller 5*a* abuts against the sheet at a predetermined feed pressure due to the urging force of the pickup spring 151. The retard roller 5*c* is rotatably supported by the retard shaft 155 via a torque limiter (not illustrated). The retard roller 5*c* is urged toward the feed roller 5*b* by a retard spring 154. Thus, the retard roller 5*c* is in pressure contact with the feed roller 5*b*, in a separation nip N1. In addition, the driving force of the feed motor M2 is transmitted to the retard shaft 155. Thus, when the feed motor M2 is driven, the retard roller 5*c* rotates in a direction in which a sheet is sent back to the cassette 40.

As illustrated in FIG. 3, an inner guide 121, an outer guide 122, and a conveyance roller pair 81 are disposed downward from the feed roller 5*b* and the retard roller 5*c* in the sheet feeding direction. The conveyance roller pair 81 includes a driving roller 81*a* and a driven roller 81*b*. The driving roller 81*a* is rotatably supported by a rotation shaft 81*c*. When the rotation shaft 81*c* is driven by a conveyance motor M3, the driving roller 81*a* rotates, and the driven roller 81*b* rotates with the driving roller 81*a*. In addition, a conveyance sensor 130 is disposed for detecting a sheet that is being conveyed. The conveyance sensor 130 is disposed upstream from a conveyance nip N2 formed between the driving roller 81*a* and the driven roller 81*b*, and downstream from the separation nip N1 in the sheet feeding direction.

Sheet Feeding Operation

Next, a sheet feeding operation of the sheet feeding apparatus 30 will be described. In a state where the cassette 40 is inserted to the apparatus body 1A, the engaging portion 143E (see FIG. 5) disposed at the leading end of the lifter shaft 143 and the engaged portion 161E (coupling 161) disposed in the apparatus body 1A are engaged with each other. When the lifter motor M1 illustrated in FIG. 2A is driven, the coupling 161 rotates, rotating the lifter shaft 143 and the lifter plate 142. Thus, the sheet stacking plate 141 is lifted by the lifter plate 142. The position of the uppermost sheet of the sheet bundle stacked on the sheet stacking plate 141 is detected by a sensor (not illustrated). Thus, as illustrated in FIG. 2B, when the sheet stacking plate 141 is located at a feed position at which the sheet can be fed, the lifter motor M1 stops, causing the sheet stacking plate 141 to stop at the feed position. In this time, the sheet S stacked on the sheet stacking plate 141 abuts against the pickup roller 5*a* of the sheet feeding portion 50.

As illustrated in FIG. 3, the feed motor M2 and the conveyance motor M3 are driven in this state to rotate the pickup roller 5*a* and feed the sheet S stacked on the sheet stacking plate 141. The sheet S fed by the pickup roller 5*a* is separated, one by one, in the separation nip N1. Specifically, when a single sheet is fed to the separation nip N1, a torque limiter (not illustrated) disposed between the retard shaft 155 and the retard roller 5*c* runs idle, and the retard roller 5*c* rotates with the feed roller 5*b*. When two or more sheets are fed to the separation nip N1, the retard roller 5*c* is rotated by the driving force of the feed motor M2 toward a direction in which other sheets, other than the first sheet and including the second sheet, are sent back to the cassette 40. Thus, the sheets are separated, one by one, in the separation nip N1; then guided to the conveyance roller pair 81 by the inner guide 121 and the outer guide 122; and then conveyed downward in the sheet feeding direction, through the conveyance nip N2 of the conveyance roller pair 81.

Here, the driving force of the feed motor M2 may not be applied to the retard roller 5*c*. That is, when a single sheet is fed to the separation nip N1, the retard roller 5*c* may be rotated with the feed roller 5*b*, by frictional force; when two or more sheets are fed to the separation nip N1, other sheets, other than the first sheet and including the second sheet, may be stopped in the sheet feeding direction such that the other sheets slip on the first sheet and cause the retard roller 5*c* to not rotate.

Configuration of Rotary Damper and its Surroundings

Figure 6A:
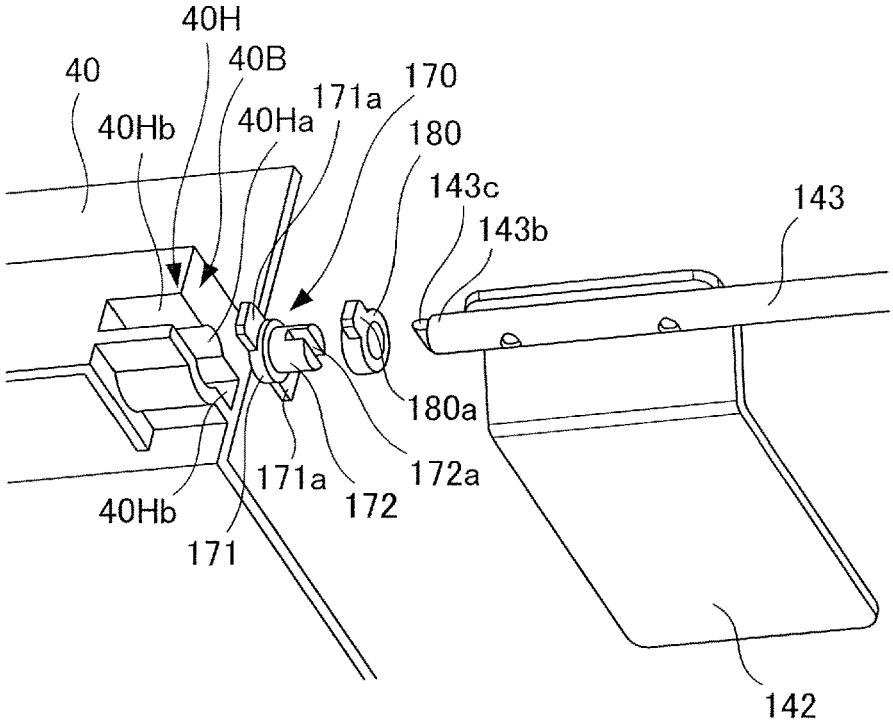
FIG. 6A is an exploded perspective view of a joining portion of the embodiment, in which the rotation shaft, a rotary damper, and the cassette are to be joined with each other.
Figure 6B:
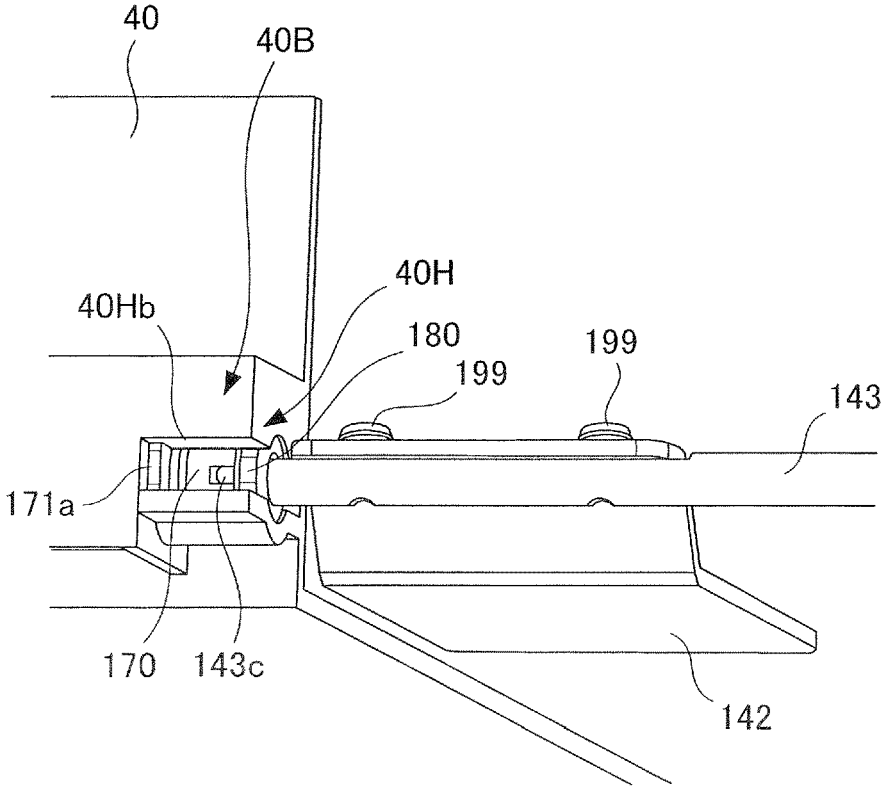
FIG. 6B is a perspective view of the joining portion of the embodiment, in which the rotation shaft, the rotary damper, and the cassette are assembled to each other.

Next, a configuration of a rotary damper 170 and its surroundings will be described with reference to FIGS. 6A and 6B. FIG. 6A illustrates a state in which the rotary damper 170 is still not assembled to the front-side supporting portion 40B. FIG. 6B illustrates a state in which the rotary damper 170 is assembled to the front-side supporting portion 40B. Here, FIGS. 6A and 6B illustrate only one portion of the cassette 40 for simplifying description.

As illustrated in FIGS. 6A and 6B, the rotary damper 170 is located on a leading end side of an end portion 143*b* of the lifter shaft 143 (the end portion 143*b* is located on the drawing direction side, that is, on the other side in the axial direction). Specifically, the rotary damper 170 is disposed on the axis of the lifter shaft 143 and the rotary damper 170 and the lifter shaft 143 are arrayed in the axial direction. Also, the rotary damper 170 is joined with the end portion 143*b*. In addition, the rotary damper 170 is disposed in the front-side supporting portion 40B. Specifically, the rotary damper 170 is housed in a housing hole 40H, which is formed in the front-side supporting portion 40B of the cassette 40.

The rotary damper 170 includes a rotary portion 172 and a fixed portion 171. The fixed portion 171 is fixed to and supported by the housing hole 40H. The rotary portion 172 is rotatably supported by the fixed portion 171. In addition, when the rotary portion 172 rotates, a predetermined amount of load torque is applied to the rotary portion 172, and the energy of rotary motion of the rotary portion 172 is reduced by the friction between the rotary portion 172 and the fixed portion 171. The fixed portion 171 includes two flange-shaped plate portions 171*a* formed on the outer circumferential surface of the fixed portion 171. In addition, the housing hole 40H includes a cylindrical hole portion 40Ha and two groove portions 40Hb formed like a groove. When the plate portions 171*a* fit in the groove portions 40Hb, and the fixed portion 171 fits in the housing hole 40H, the fixed portion 171 is fixed to and supported by the cassette 40 so as not to rotate with respect to the cassette 40.

The rotary portion 172 has a concave keyway 172*a*, and the leading end of the end portion 143*b* of the lifter shaft 143 has a convex key 143*c*. Thus, the keyway 172*a* and the key 143*c* mesh with each other so that the rotary portion 172 and the lifter shaft 143 join with each other and rotate in the rotational direction. In addition, a bearing portion 180 is disposed on the outer circumferential surface of the rotary portion 172 and the outer circumferential surface of the leading end of the end portion 143*b* of the lifter shaft 143. The bearing portion 180 has a plate portion 180*a* formed like a flange. Thus, when the plate portion 180*a* fits in one of the groove portions 40Hb, and the other portion of the bearing portion 180 fits in the hole portion 40Ha, the bearing portion 180 is supported by the cassette 40 so as not to rotate with respect to the cassette 40. The bearing portion 180 receives a load that is received by the lifter shaft 143 in a radial direction, and supports the rotary portion 172 and the lifter shaft 143 so that the rotary portion 172 and the lifter shaft 143 can rotate with respect to the cassette 40. In addition, since the bearing portion 180 covers the outer circumferential surface of the key 143*c* and the outer circumference of the keyway 172*a*, i.e., the bearing portion 180 covers ends of the keyway, the bearing portion 180 serves as a separation prevention portion that prevents the key 143*c* from being separated from the keyway 172*a* in a direction in which the keyway 172*a* extends.

Here, although the key 143*c* is formed on the lifter shaft 143 and the keyway 172*a* is formed in the rotary portion 172 in the present embodiment, the keyway 172*a* may be formed in the lifter shaft 143 and the key 143*c* may be formed on the rotary portion 172. That is, the key 143*c* may be formed on one of the lifter shaft 143 and the rotary portion 172, and the keyway 172*a* may be formed in the other. In another case, the key and the keyway may not be formed. For example, the lifter shaft 143 and the rotary portion 172 may be joined with each other by meshing teeth of the lifter shaft 143 and teeth of the rotary portion 172, or by bonding or welding the lifter shaft 143 and the rotary portion 172. That is, any joint structure may be used as long as the structure can join the lifter shaft 143 and the rotary portion 172 and rotate them in the rotational direction.

Operation Performed when Cassette is Drawn from Apparatus Body

When the above-described sheet feeding operation is completed, the lifter plate 142 and the sheet stacking plate 141 are located at positions to which they have been lifted, as illustrated in FIG. 2B. When the cassette 40 is drawn from the apparatus body 1A in this state, the engaging portion 143E of the lifter shaft 143 disposed on the insertion direction side (i.e. back side) is disengaged from the engaged portion 161E of the coupling 161, which is included in the driving-force transmission mechanism 160 that transmits the driving force produced from the lifter motor M1. As a result, the lifter plate 142 and the sheet stacking plate 141 start to drop.

When the lifter plate 142 drops, the lifter shaft 143 is rotated in a direction opposite to a direction in which the lifter shaft 143 is rotated when the lifter plate 142 is lifted. In this time, the load torque of the rotary damper 170 is applied to the lifter shaft 143 against the rotation of the lifter shaft 143, and thereby the rotary motion of the lifter shaft 143 is reduced by the rotary damper 170. Consequently, the collision sound caused when the sheet stacking plate 141 drops onto the bottom surface of the cassette 40 can be suppressed.

As described above, the rotary damper 170 is disposed on the drawing direction side (i.e. front side) in the axial direction of the lifter shaft 143, adjacent to the lifter shaft 143 in the axial direction. This arrangement eliminates the need of disposing the rotary damper 170 on the outer circumferential surface of the lifter shaft 143, so that it is unnecessary to secure space around the outer circumferential surface of the lifter shaft 143 in the cassette 40. In addition, the rotary damper 170 can be downsized in its radial direction. Thus, the rotary damper 170 can be arranged in a space-saving manner for suppressing the collision sound.

Modifications

Here, in the present embodiment, the rotary damper 170 produces load torque caused by friction in the rotational direction. However, the present disclosure is not limited to this. For example, the load torque may be produced by using fluid or gas. That is, the rotary damper may have any configuration.

In addition, in the present embodiment, the lifter shaft 143 and the rotary portion 172 of the rotary damper 170 are directly joined with each other. However, for reducing the load of the lifter motor M1 when the sheet stacking plate 141 is lifted, a member having a one-way clutch function may be disposed. In this case, the member performs an idling operation when the sheet stacking plate 141 is lifted, and performs an engagement operation when the sheet stacking plate 141 drops. For example, gears such as a star ratchet may be disposed between the lifter shaft 143 and the rotary damper 170 in the axial direction.

In addition, in the present embodiment, the separation nip is formed between the feed roller and the retard roller. However, the present disclosure is not limited to this. For example, the separation nip may be formed between the feed roller and a separation pad. In another case, the feed roller may not be disposed. In this case, the separation nip may be formed between the pickup roller and the separation pad.

In addition, although the sheet is fed by the pickup roller in the present embodiment, the sheet may be fed by blowing air on the sheet. That is, any feeding system may be used.

In addition, in the present embodiment, the sheet feeding apparatus 30 is included in the image forming apparatus 1. However, the present disclosure is not limited to this. For example, the sheet feeding apparatus 30 may be externally connected to the image forming apparatus or an image reading apparatus. That is, the sheet feeding apparatus 30 may be a so-called sheet feeding deck.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-246302, filed Dec. 27, 2018, which is hereby incorporated by reference herein in its entirety.

What is claimed is:

1. A sheet feeding apparatus comprising:

a storage portion configured to store a sheet;

a sheet supporting portion configured to support the sheet, the sheet supporting portion being supported so as to be able to pivot on a fulcrum disposed in the storage portion, and being configured to lift the sheet when the sheet supporting portion pivots;

a feed portion disposed above the sheet supporting portion and configured to feed the sheet lifted by the sheet supporting portion;

a drive portion configured to output driving force that lifts the sheet supporting portion;

a rotation shaft rotatably supported by the storage portion and comprising an engaging portion disposed on one end side in an axial direction of the rotation shaft, the engaging portion being configured to engage with the drive portion;

a pressing portion fixed to the rotation shaft and configured to press the sheet supporting portion from below when the rotation shaft is rotated by the drive portion; and a rotary damper disposed so as to join with the rotation shaft and configured to reduce rotary motion of the rotation shaft, wherein the pressing portion is disposed between the engaging portion and the rotary damper in the axial direction.

2. The sheet feeding apparatus according to claim 1, wherein the storage portion is supported by an apparatus body so as to be able to be inserted to and drawn from the apparatus body, wherein the drive portion is disposed in the apparatus body, wherein the one end side of the rotation shaft in the axial direction is a leading end side of an insertion direction of the storage portion, wherein the rotary damper is disposed on a front side rather than the pressing portion in a drawing direction of the storage portion, and wherein the engaging portion of the rotation shaft is engaged with the drive portion when the storage portion is inserted to the apparatus body, and is disengaged from the drive portion when the storage portion is drawn from the apparatus body.

3. The sheet feeding apparatus according to claim 2, wherein the axial direction of the rotation shaft is a direction in which the storage portion is inserted to and drawn from the apparatus body.

4. The sheet feeding apparatus according to claim 1, wherein the rotary damper comprises a rotary portion and a fixed portion supported by the storage portion, wherein the fixed portion supports the rotary portion such that the rotary portion is able to rotate, and reduces rotary motion of the rotary portion, wherein the rotary portion and the rotation shaft are arranged in the axial direction of the rotation shaft, and the rotary portion is joined with an end portion of the rotation shaft such that the rotary portion is not able to rotate with respect to the end portion.

5. The sheet feeding apparatus according to claim 4, further comprising a bearing portion configured to support the rotary portion and the rotation shaft such that the rotary portion and the rotation shaft are able to rotate with respect to the storage portion.

6. The sheet feeding apparatus according to claim 5, wherein one of the end portion of the rotation shaft and the rotary portion comprises a key and the other of the end portion of the rotation shaft and the rotary portion comprises a keyway, and wherein the bearing portion covers ends of the keyway and prevents the key from being separated from the keyway in a direction in which the keyway extends.

7. The sheet feeding apparatus according to claim 4, wherein the storage portion comprises a housing hole configured to house the fixed portion such that the fixed portion is not able to rotate.

8. The sheet feeding apparatus according to claim 7, further comprising a bearing portion configured to support the rotary portion and the rotation shaft such that the rotary portion and the rotation shaft are able to rotate with respect to the storage portion, and wherein the housing hole houses the bearing portion such that the bearing portion is not able to rotate.

9. An image forming apparatus comprising:

the sheet feeding apparatus according to claim 1; and an image forming portion configured to form an image on a sheet fed from the sheet feeding apparatus.

10. The sheet feeding apparatus according to claim 1, wherein the rotary damper comprises a rotary member and a fixed member supported by the storage portion, wherein the fixed member is configured to support the rotary member such that the rotary member rotates about a rotation axis parallel with the axial direction, and wherein the rotary member is joined with an end portion of the rotation shaft such that the rotary member cannot rotate with respect to the rotation shaft about the rotation axis.

11. The sheet feeding apparatus according to claim 10, wherein the rotary damper is configured to reduce energy of rotary motion of the rotary member by friction between the rotary member and the fixed member generated when the rotary member rotates.

12. The sheet feeding apparatus according to claim 10, wherein the rotary damper is configured to reduce energy of rotary motion of the rotary member by fluid provided between the rotary member and the fixed member when the rotary member rotates.

* * * * *